US007456802B1

(12) United States Patent
Bourgeois

(10) Patent No.: US 7,456,802 B1
(45) Date of Patent: Nov. 25, 2008

(54) ADJUSTABLE MOUNTING BRACKET FOR SATELLITE DISHES

(76) Inventor: Donald Bourgeois, 4741 Jasper St., Metairie, LA (US) 70006

( * ) Notice: Subject to any disclaimer, the term of this patent is extended or adjusted under 35 U.S.C. 154(b) by 0 days.

(21) Appl. No.: 11/854,239

(22) Filed: Sep. 12, 2007

(51) Int. Cl.
*H01Q 1/12* (2006.01)

(52) U.S. Cl. ..... 343/878; 343/892; 343/880

(58) Field of Classification Search ..... 343/878, 343/880, 882, 881, 890, 891, 892
See application file for complete search history.

(56) References Cited

U.S. PATENT DOCUMENTS

| | | | | |
|---|---|---|---|---|
| 514,758 | A | 2/1894 | Lewis | |
| 516,576 | A | 3/1894 | Roberts | |
| 546,019 | A | 9/1895 | Logan | |
| 633,874 | A | 9/1899 | Mee, Sr. | |
| 1,153,371 | A | 9/1915 | Carter | |
| 1,612,655 | A | 12/1926 | Rudin | |
| 2,625,353 | A | 1/1953 | Henry | |
| 2,695,149 | A | 11/1954 | Chabot | |
| 3,094,303 | A | 6/1963 | Belger | |
| 4,181,284 | A | 1/1980 | Seppelfrick | |
| 4,510,502 | A | 4/1985 | Hovland et al. | |
| 4,605,333 | A | 8/1986 | Hovland et al. | |
| 5,334,990 | A | 8/1994 | Robinson | |
| 5,617,680 | A | 4/1997 | Beatty | |
| 5,647,567 | A | 7/1997 | Pugh, Jr. et al. | |
| 5,829,724 | A | 11/1998 | Duncan | |
| 5,870,059 | A * | 2/1999 | Reynolds | 343/760 |
| 5,961,092 | A | 10/1999 | Coffield | |
| 5,982,340 | A | 11/1999 | Troche | |
| 6,195,066 | B1 | 2/2001 | Pegues, Jr. et al. | |
| 6,237,888 | B1 | 5/2001 | Coll | |
| 6,460,821 | B1 | 10/2002 | Rhudy et al. | |
| 6,727,861 | B2 | 4/2004 | Antoine | |
| 6,731,250 | B1 | 5/2004 | Berman | |
| 6,963,316 | B1 * | 11/2005 | Lin | 343/882 |
| 2005/0001781 | A1 | 1/2005 | Antoine | |
| 2006/0038728 | A1 * | 2/2006 | McEwan | 343/713 |
| 2007/0017741 | A1 | 1/2007 | Martinez et al. | |

* cited by examiner

*Primary Examiner*—HoangAnh T Le
(74) *Attorney, Agent, or Firm*—Garvey, Smith, Nehrbass & North, L.L.C.; Brett A. North

(57) ABSTRACT

A mounting bracket having first and second hinged connectors, for attaching a satellite antenna dish to a fascia and soffit/wall of a home.

16 Claims, 6 Drawing Sheets

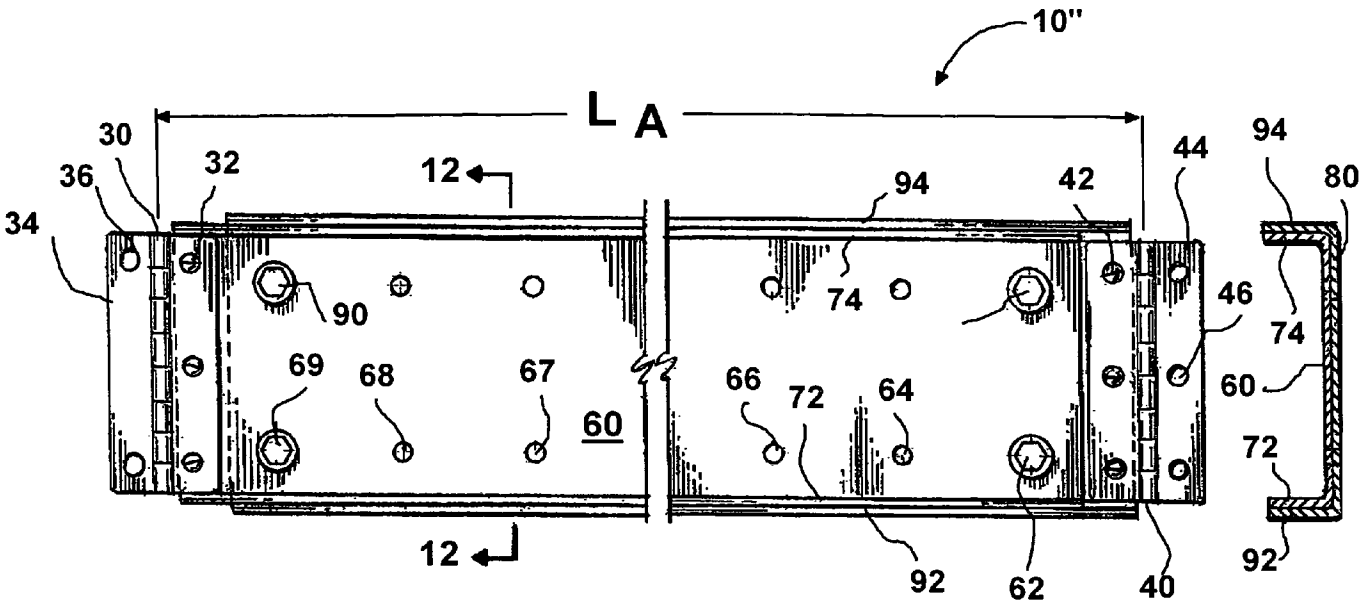
FIG. 12
FIG. 10
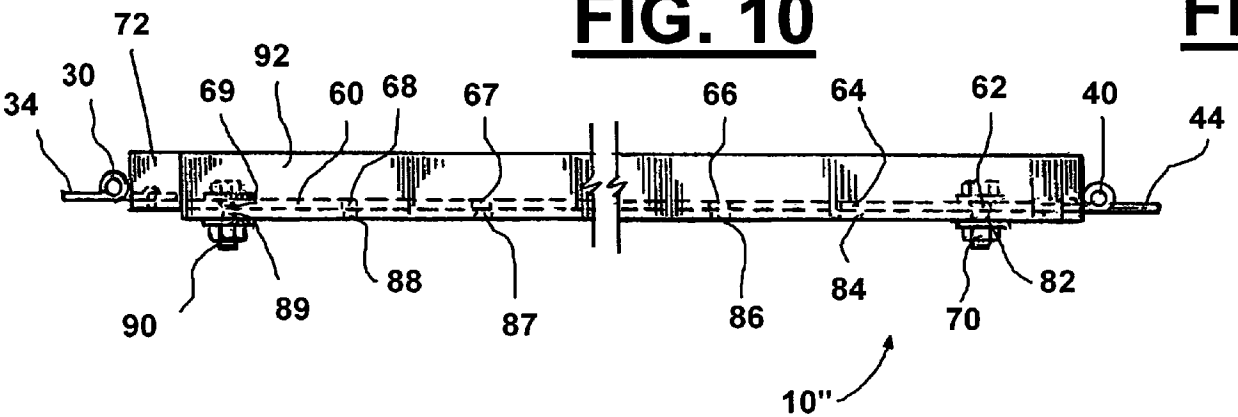
FIG. 11

ADJUSTABLE MOUNTING BRACKET FOR SATELLITE DISHES

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND

This application is generally related to antenna mounting brackets and more particularly to an adjustable mounting bracket for mounting a satellite dish antenna on a variety of building constructions.

In Direct Broadcast Satellite (DBS), small, dish-shaped antennas are used to receive television signals, which are broadcast by satellites in geosynchronous orbits.

While the physical size required of satellite dish antennas for receiving clear audio and video signals has decreased as a result of increased satellite receiver sensitivity, the reduced size has made it desirable to mount satellite antennas on building themselves, such as residences, as opposed to being ground mounted. Typically, an unobstructed view of an appropriate satellite operable with the antenna is achieved by mounting the satellite dish antenna on the roof or a cantilevered mount attached to the sidewall of the home. However, mounting on what is typically a pitched roof often results in diminishing the integrity of the roof which can cause leaks (as a result of drilling through the roofing material). Additionally, cantilevered mounting to sidewalls typically requires penetrating concrete block and the need for special tools and concrete anchors as suggested in U.S. Pat. No. 6,195,066 to Peques, Jr. et al. describing a satellite dish mounting arm for mounting to a vertical sidewall of a building.

Various mounts for mounting small, dish-shaped antennas or other antennas on horizontal surfaces or on sloped roofs are exemplified in prior art patents including U.S. Pat. No. 4,510,502 to Hovland et al which discloses a dish antenna mounting structure including an upright mast for supporting the dish antenna.

U.S. Pat. No. 5,334,990 to Robinson discloses a portable satellite dish antenna system comprising a dish-shaped member having an inner surface that includes a central flat area and a plurality of annular parabolically-shaped segments concentric with the central circular flat area for providing a plurality of focal points over the inner surface of the dish-shaped member. U.S. Pat. No. 5,647,567 to Pugh, Jr. et al. for an antenna mounting bracket further emphasizes that manufacturers typically advise users to avoid mounting the antenna on the eave of a house because of the eave's lack of structural integrity.

U.S. Pat. No. 5,617,680 to Beatty discloses a satellite dish mounting structure having an elevated bridge portion for supporting a mounting foot of the satellite dish. The bridge portion is integrally connected to and supported by two narrow leg positions which in turn are integrally connected to and supported by two narrow foot portions. The bridge portion is elevated from two top portions by the leg portions in order to clear the uneven surface of the roof or wall of the house.

U.S. Pat. No. 5,829,724 to Duncan discloses a primary strut, which is tubular, and has a straight, upper portion, a straight intermediate portion, and a straight, lower portion. The upper portion is bent at a juncture between the upper and intermediate portions and at a lower juncture between the intermediate and lower portions.

One of the problems with mounting satellite dishes on a home is that the satellite's mounting bracket is typically too large to completely fit on the fascia (under the gutter) of a home, and the bottom portion of bracket must be braced. However, houses vary in construction and particularly, the distance from the bottom portion of the satellite mounting bracket and the soffit to which support can be provided, vary. Additionally, the angle between the soffit and fascia can vary. Accordingly, there is a need for a method and apparatus which can accommodate installation of the satellite antenna dish on the fascia of homes under numerous home constructions.

There is needed a method and apparatus for easily and inexpensively securing a satellite antenna to the fascia of a building. There is a further need to provide a method and apparatus for mounting the antenna to the fascia of a building while maintaining sufficient structural integrity when supporting the antenna under its planned use.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation may be made without departing in any way from the spirit of the present invention. No feature of the invention is critical or essential unless it is expressly stated as being "critical" or "essential."

BRIEF SUMMARY

The apparatus of the present invention solves the problems confronted in the art in a simple and straightforward manner. What is provided is a method and apparatus for mounting a satellite dish antenna to a building using the fascia as part of the structural support for the antenna.

In one embodiment is provided an apparatus for mounting a satellite antenna dish assembly to the fascia and soffit of a building, the apparatus comprising a bracket having a base portion with spaced apart pivoting connection points. The base portion including first and second pivoting connectors for securing the base to both the antenna dish and a second area of connection such as the soffit.

In one embodiment the base portion can be adjustable or telescoping to increase or decrease its longitudinal length.

In one embodiment the base portion is a plate.

In one embodiment the first and second pivoting connectors can each include a plurality of connecting openings for receiving fasteners.

In one embodiment a method and apparatus of securing a satellite antenna dish to a fascia of a home comprises the steps of: (a) providing a mount including a base portion having first and second pivoting connectors; (b) attaching the satellite antenna dish to the fascia; (c) attaching the first connector to the satellite antenna dish; and (d) attaching the second pivoting connector to the building.

In one embodiment the second pivoting connector is positioned onto a soffit such that its holes are aligned with a supporting member, such as a truss or stud, to which the soffit is attached, the soffit being positioned between the second pivoting connector and the supporting member.

In one embodiment the second pivoting connector is secured to the soffit by having screws extend through the holes, through the soffit, and into a structural member such as a rafter or joist.

In one embodiment the method and apparatus for installing a satellite dish antenna to a fascia of a home which includes the steps of: (a) providing a bracket with double hinged ends; (b) attaching one end of a double hinged bracket to a satellite dish antenna; (c) attaching the satellite dish to the fascia of a home; and (d) attaching the second end of the double hinged bracket to the home.

In one embodiment the second end of the double hinged bracket is attached to the soffit of the home.

In one embodiment the second end of the double hinged bracket is attached to the wall of the home.

In one embodiment the double hinged bracket includes an adjustable body which allows adjusting the longitudinal length of the bracket.

In one embodiment the double hinged bracket includes a plurality of channels which are slidably connected to one another.

In one embodiment the satellite dish antenna is mounted on the fascia below a gutter.

In one embodiment the satellite dish antenna along with its mounting system spans vertically from below the gutter to above the gutter.

In one embodiment the gutter includes front and rear portions with the rear portion being attached to the fascia of the home, and the satellite dish antenna is mounted on the fascia at the rear portion of the gutter and the satellite dish antenna along with its mounting system cradles the gutter from the bottom of the gutter to the top, and from the rear of the gutter to its front.

In one embodiment the second end of the double hinged bracket is attached to a soffit where the soffit is substantially horizontal.

In one embodiment the second end of the double hinged bracket is attached to a soffit where the soffit is substantially angled from a horizontal. In various embodiments the angle can be about 5, 10, 15, 20, 25, 30, 35, 40, 45, 50, 55, 60, 65, 70, and/or 75 degrees. In various embodiments the angle can be within the range of any two of the above references angular measurements.

In one embodiment, the adjustable bracket includes a pair of plates—at least one of which having openings at longitudinally spaced apart locations such that the plates can be fastened at particular selected longitudinal lengths. In one embodiment both plates have a plurality of openings at longitudinally spaced apart locations. In one embodiment the number of longitudinal openings in the first plate equal the number in the second plate. In one embodiment the openings are made in pairs of openings at longitudinally spaced apart locations.

In one embodiment a plurality of fasteners can be used to lock in place the first and second plates.

In one embodiment first and second plates are C-channels which can be slidably positioned relative to each other. In one embodiment one of the plates has channels in which the other plate is slidably connected (and a set screw can be used to longitudinally fix the location of the first plate relative to the second plate).

The drawings constitute a part of this specification and include exemplary embodiments to the invention, which may be embodied in various forms.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 10 is a top view of an alternative mounting bracket whose length is adjustable and includes a c-channel cross section.

FIG. 11 is a side view of the mounting bracket of FIG. 10.

FIG. 12 is a sectional view of the mounting bracket of FIG. 10 taken along the lines 12-12.

DETAILED DESCRIPTION

Figure 1:
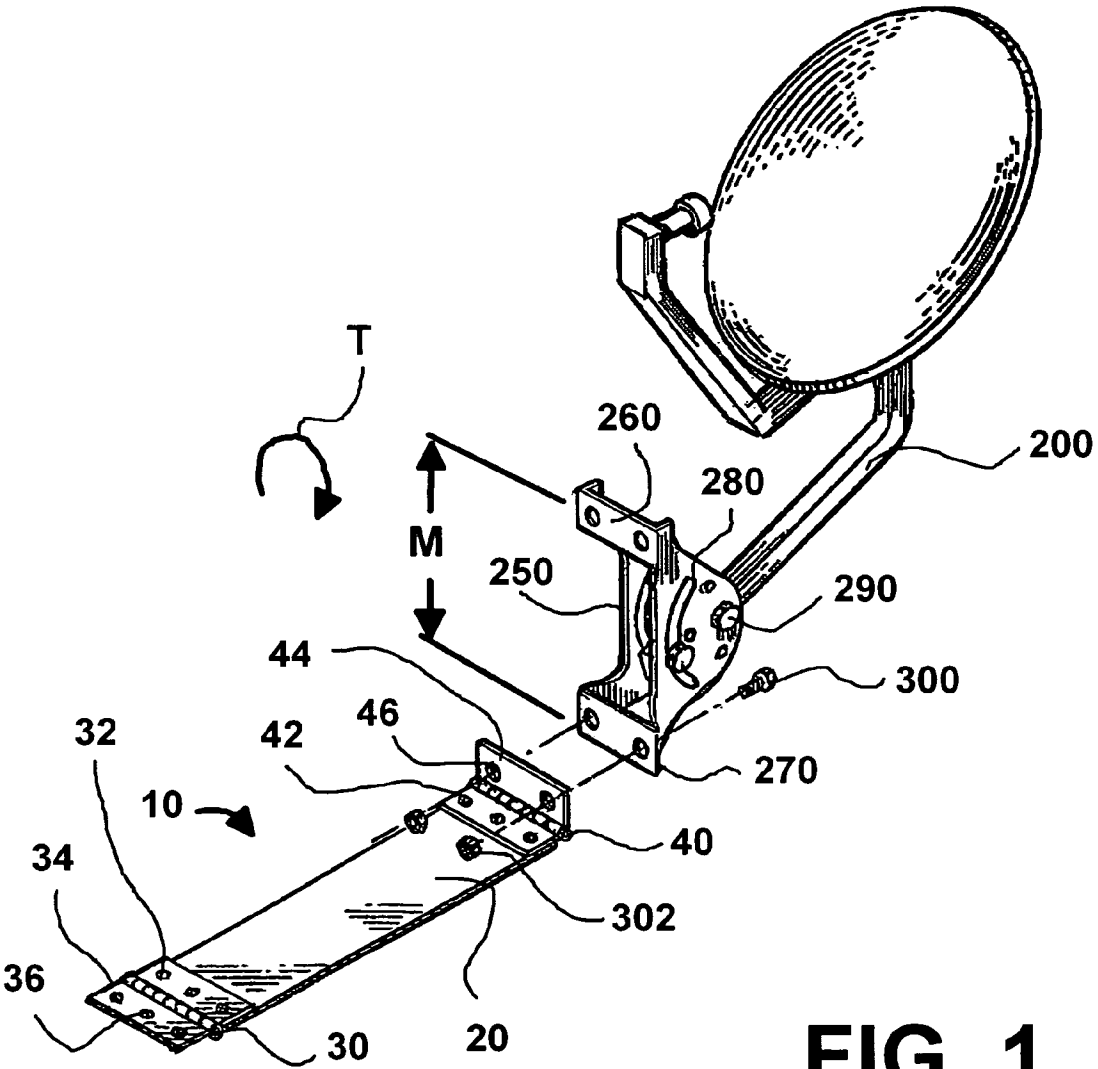
FIG. 1 is a perspective view of a mounting bracket and satellite antenna which can be used in the method and apparatus of a preferred embodiment, the mounting bracket having first and second pivoting connectors.

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

In one embodiment mounting bracket 10 includes first and second pivoting connectors 34, 44 which can be used to mount a satellite antenna dish 200 to the fascia 110 and soffit 120 of a home 100. In one embodiment the pivoting connectors are hinged.

Mounting can be achieved for a wide variety of fascia 110 and soffit 120 constructions. In one embodiment bracket 10 can include plate 20 (which can be rectangular in length and cross section) with first and second hinge mounts 30 and 40 (See FIGS. 1 and 2). Hinge mounts 30 and 40 allow the mounting satellite antenna dish 200 on soffits and fascias which are not at ninety degrees to one another (see FIGS. 3 and 4).

Figure 7:
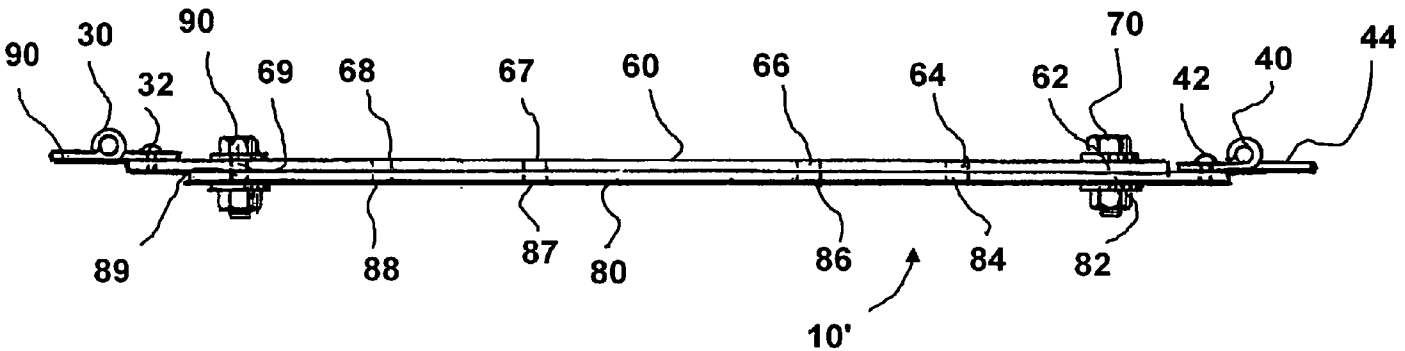
FIG. 7 is a side view of the mounting bracket of FIG. 6.
Figure 8:
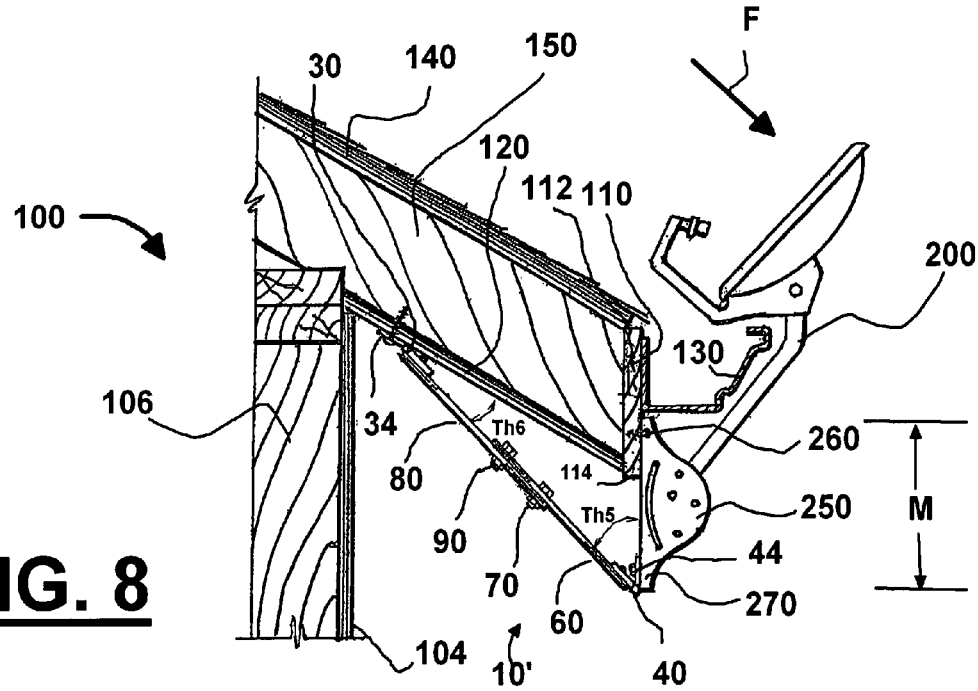
FIG. 8 is a side view of the second pivoting connector of the mounting bracket of FIG. 6 being attached to the soffit where the soffit is substantially inclined.

In an alternative embodiment the length LA of bracket 10' can also be adjusted. Bracket 10' can include first section 60 and second section 80 which can be longitudinally adjusted relative to each other. One form of adjustment can include a plurality of openings and fasteners which can be used for multiple lengths. In another embodiment first section 60 can be slidably connected to second section 80 (such as by making first section a C-channel, e.g., by crimping closed its ends). FIGS. 7 through 8 show various circumstances where adjustable length brace 10' can be used. The spaced apart pivoting mounting portions 34, 44 reinforce an inherently weak building fascia 110 by distributing loads from the satellite dish antenna 200 between the fascia 110 and soffit 120 and resists torsional loading on fascia 110.

FIG. 1 shows a conventionally available satellite antenna dish 200 with its mount 250. In one embodiment of the method and apparatus, mount 250 can be attached to fascia 110 of a home 100 (e.g., see FIG. 4). One of the problems with mounting satellite antenna dishes 200 on the fascia of a home 100 is that the satellite's mount 250 is typically to large to completely fit on fascia 110 (which is required to be placed under gutter 130 where gutter 130 is used) and the lower portion 270 of mount 250 must be braced against loading expected to be seen after satellite installation.

Figure 4:
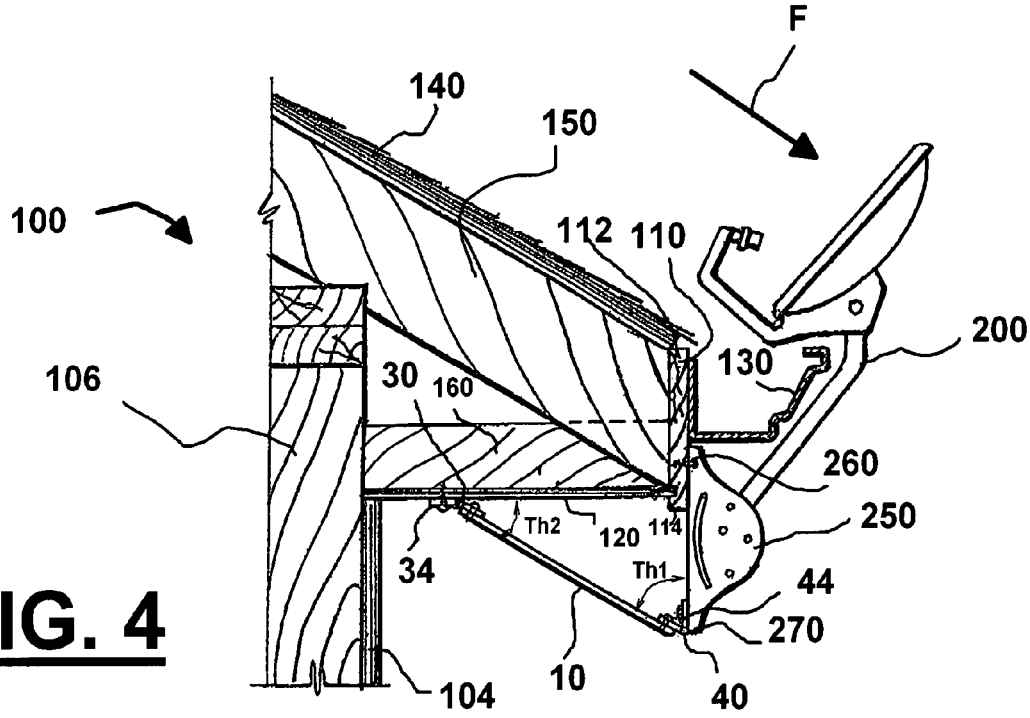
FIG. 4 is a side view of the second pivoting connector of the mounting bracket of FIG. 1 being attached to the soffit where the soffit is substantially horizontal.

In one embodiment bracing against loading is achieved by a mounting bracket 10 connected to the soffit 120 (e.g., see FIG. 4). However, houses vary in both configuration and construction, and particularly, the distance varies from the lower portion of mount 270 and soffit 120 to which support can be provided. Additionally, the angle between the soffit 120 and fascia 110 can vary. Accordingly, an adjustable mounting bracket 10 is needed to accommodate these various circumstances which is easily installed for multiple situations.

Mount 250 for satellite antenna dish 200 can comprise upper portion 260 and lower portion 270. Additionally, mount 250 can include adjustment track 280 and pivot point 290. Mount 250 is conventionally available with the purchase of satellite antenna 200. The distance between upper portion 260 and lower portion 270 is the effective moment arm M for resisting torsional loads T placed on satellite antenna dish 200 (after being installed on home 100) such as by high winds on the dish portion itself.

Figure 2:
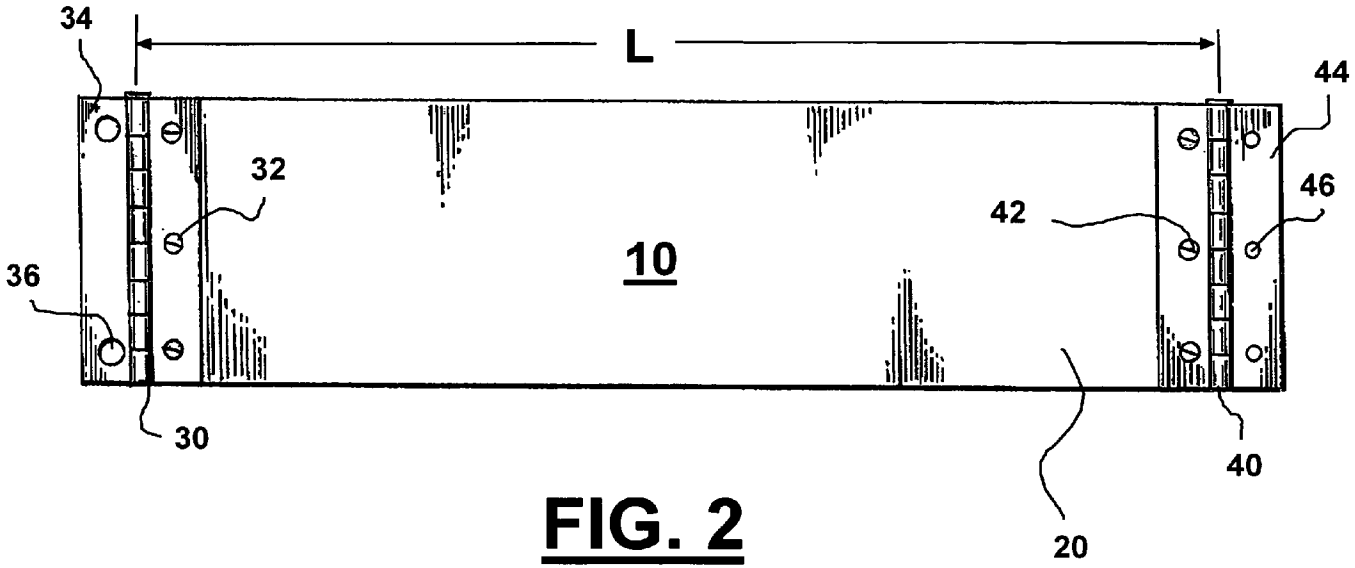
FIG. 2 is a top view of the mounting bracket of FIG. 1.
Figure 3:
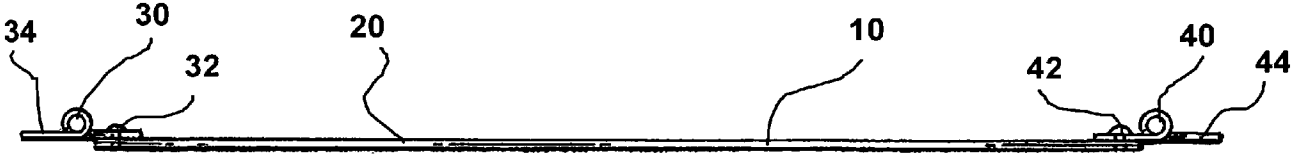
FIG. 3 is a side view of the mounting bracket of FIG. 2.
Figure 5:
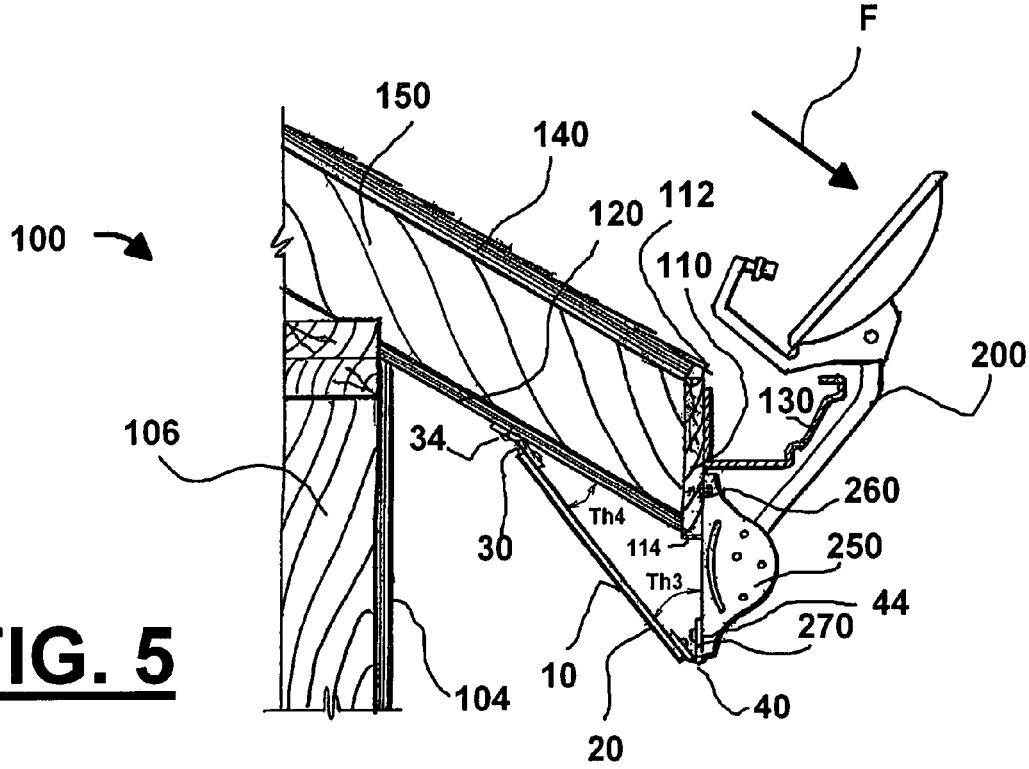
FIG. 5 is a side view of the second pivoting connector of the mounting bracket of FIG. 1 being attached to the soffit where the soffit is substantially inclined or pitched.

FIG. 1 is a perspective view of a mounting bracket 10 and satellite antenna dish 200. FIG. 2 is a top view of the mounting bracket 10. FIG. 3 is a side view of the mounting bracket 10. FIG. 4 is a side view of satellite antenna dish 200 mounted with mounting bracket 10 attached to soffit 120 where soffit 120 is substantially horizontal. FIG. 5 is a side view of satellite antenna dish 200 mounted on a home 100 with mounting bracket 10 attached to soffit 120 where soffit 120 is substantially inclined.

Mounting bracket 10 can comprise plate 20 and include first and second hinged connectors 34, 44. First hinged connector 34 can pivot at hinged connection 30 and can be connected to plate 20 through a plurality of fasteners (or other conventionally available connection means such as threaded fasteners, rivets, poppets, adhesives, welding, etc.). Second hinged connector 44 can pivot at 40 and can be connected to plate 20 through a plurality of fasteners (or other conventionally available connection means such as threaded fasteners, rivets, poppets, adhesives, welding, etc.).

Plate 20 can be a rectangular plate of various lengths and cross sections. The lengths can be about 6, 7, 8, 9, 10, 11, 12, 13, 14, 15, 16, 17, 18, 19, 20, 21, 22, 23, 24, 26, 28, 30, 32, 34, and/or 36 inches, or any range of lengths between any two of the above referenced lengths. Its width can be about ½, 1, 2, 3, 4, 5, 6, 7, 8, 9, 10, 11, and/or 12 inches, or any range of widths between any of two of the above referenced widths. Its thickness can be about 1/16, ⅛, ¼, ⅓, ½, ¾, and 1 inches, or any range of thickness between any two of the above referenced thicknesses. Plate 20 preferably has a rectangular cross section. Plate 20 should be constructed of materials sufficient to withstand the stresses and forces in normal usages from the various mounting situations for satellite antenna dish 200. In a preferred embodiment plate 20 can be metal such as steel or aluminum, and have a rectangular cross section. In other embodiments plate 20 can be comprised of plastic, wood, or of a composite construction.

Second mounting portion 44 of mounting bracket 10 can be connected to mount 250 at its lower portion 270 using a plurality of threaded fasteners 300 which having locking nuts 302.

In a preferred embodiment of the method and apparatus, mount 250 of satellite antenna dish 200 is mounted on fascia 110 (and below gutter 130). However, typically there is not enough free space on fascia 110 and the lower portion 270 of mount 250 will be spaced below the bottom of fascia 110 (such as shown in FIGS. 4, 5, 8, and 9). Accordingly, lower portion 270 of mount 250 should be supported from torsional or bending loads from satellite antenna dish 200 which can be expected from natural causes such as wind loading on the dish portion.

Figure 9:
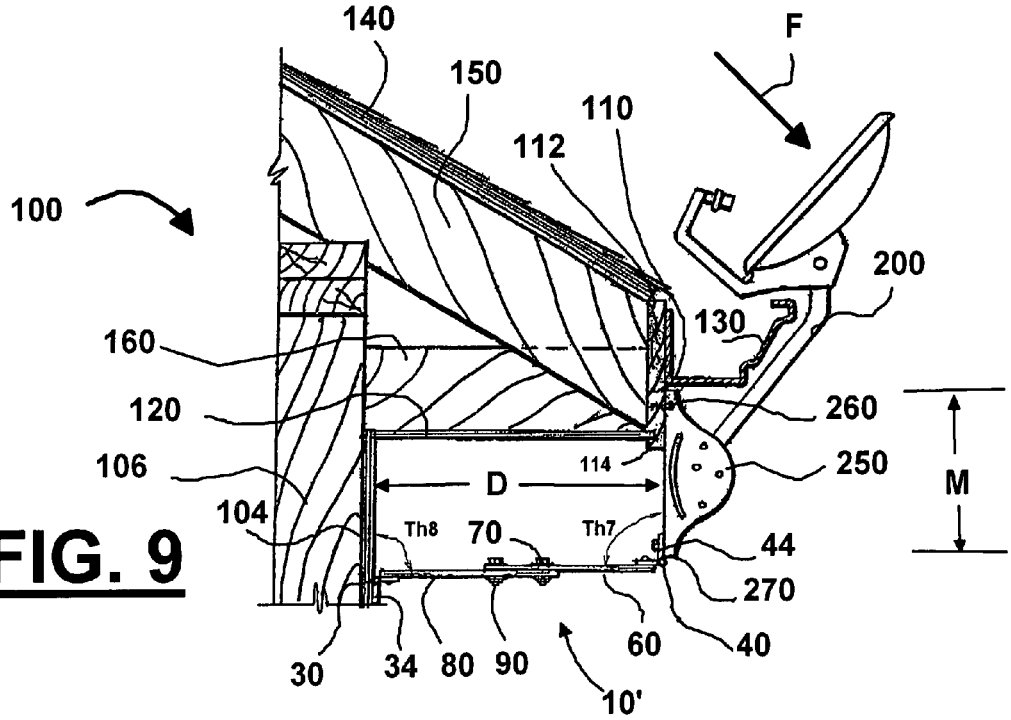
FIG. 9 is a side view of the second pivoting connector of the mounting bracket of FIG. 6 being attached to the wall of a building.

One challenge faced by the installer is the numerous configurations and constructions of houses 100. FIGS. 4, 5, 8, and 9 show several examples of different home configurations and constructions. Typically, a home 100 will have a sloped roof 140 which is supported by a plurality of rafters 150. The roof 140 will extend past the sidewall 104. On the outer perimeter can be found a fascia 110 and from the fascia 110 will be a soffit 120. The soffit 120 will typically extend from the fascia 110 to the side wall 104. Supporting the side wall 106 will be a plurality of studs. Now the soffit can be substantially horizontal as shown in FIGS. 4 and 9, and therefore will be supported by a plurality of horizontal joists, which themselves can be attached to a portion of the plurality of studs 106. In some houses 100 the soffit 120 will be attached directly to the rafters 150 and typically be skewed in relation to the horizontal as the rafters supporting the roof are also skewed providing a pitched roof. Also typically homes will have a perimeter gutter 130 attached to the fascia 110. Although not shown in the figures, in one embodiment is provided a method and apparatus for installing a satellite antenna dish 200 where mount 250 is connected on a fascia 110, which fascia 110 does not have a gutter, but lower portion 270 still is extended below the bottom of fascia 110 to allow bracket 10 to be connected to lower portion 270 and resist torsional loading. Otherwise, both upper and lower portions 260, 270 are attached to fascia 110, torsional loading from satellite antenna dish 200 transmitted to fascia 110 from mount 250 may tend to cause fascia 110 to fail.

FIG. 4 shows one embodiment for the method and apparatus. FIG. 4 is a side view of satellite antenna dish 200 mounted with mounting bracket 10 attached to soffit 120 which soffit 120 is substantially horizontal to a ground surface (although the ground surface is not shown). In FIG. 4 fascia 110 includes top 112 and bottom 114 surfaces. Gutter 130 is attached to fascia 110. Upper portion 260 of mount 250 is connected to fascia 110 between top 112 and bottom 114 surfaces and, more particularly, between the bottom of gutter 130 and bottom 114 of fascia. This connection can be by a plurality of fasteners (such as wood screws, threaded bolts and nuts, nails, rivets, adhesives, etc.). In this mounting situation lower portion 270 of mount 250 extends below bottom 114 of fascia 110. Loads on satellite antenna dish 200 after installation can place torsional or bending loading on mount 250 and accordingly on any item to which mount 250 is connected. To address this torsional or bending loading mounting bracket 10 can be attached to lower portion 270 of mount 250 through second mounting portion 44 of mounting bracket 10. Second mounting portion 44 is hinged at hinged connection 40 and allows plate 20 to form an angle theta 2 relative to mount 250. First mounting portion 34 can be connected to soffit 120, preferably in a joist 150. First mounting portion can be pivotally connected to plate 20 through hinged connection 30 and allows connection by forming angle theta 1 with soffit 120. Loading on satellite antenna dish 200 is schematically indicated by force F in FIG. 4. This loading will cause both force and torsional loading on mount 250. Mounting bracket 10 will resist such loading and transfer the forces to soffit 120 and rafter 150.

FIG. 5 shows another embodiment for the method and apparatus. FIG. 5 is a side view of satellite antenna dish 200 mounted with mounting bracket 10 attached to soffit 120 which soffit 120 is angled relative to a ground surface (although the ground surface is not shown). In FIG. 5 fascia 110 includes top 112 and bottom 114 surfaces. Gutter 130 is attached to fascia 110. Upper portion 260 of mount 250 is connected to fascia 110 between top 112 and bottom 114 surfaces and, more particularly, between the bottom of gutter 130 and bottom 114 of fascia. This connection can be by a plurality of fasteners (such as wood screws, threaded bolts and nuts, nails, rivets, adhesives, etc.). In this mounting situation lower portion 270 of mount 250 extends below bottom 114 of fascia 110. Loads on satellite antenna dish 200 after installation can place torsional or bending loading on mount 250 and accordingly on any item to which mount 250 is connected. To address this torsional or bending loading mounting bracket 10 can be attached to lower portion 270 of mount 250 through second mounting portion 44 of mounting bracket 10. Second mounting portion 44 is hinged at hinged connection 40 and allows plate 20 to form an angle theta 3 relative to mount 250. First mounting portion 34 can be connected to soffit 120, preferably in a rafter 150. First mounting portion can be pivotally connected to plate 20 through hinged connection 30 allowing connection by forming angle theta 4 with soffit 120. Loading on satellite antenna dish 200 can be resisted by mounting bracket 10 which transfers the loading forces to soffit 120 and rafter 150.

Figure 6:
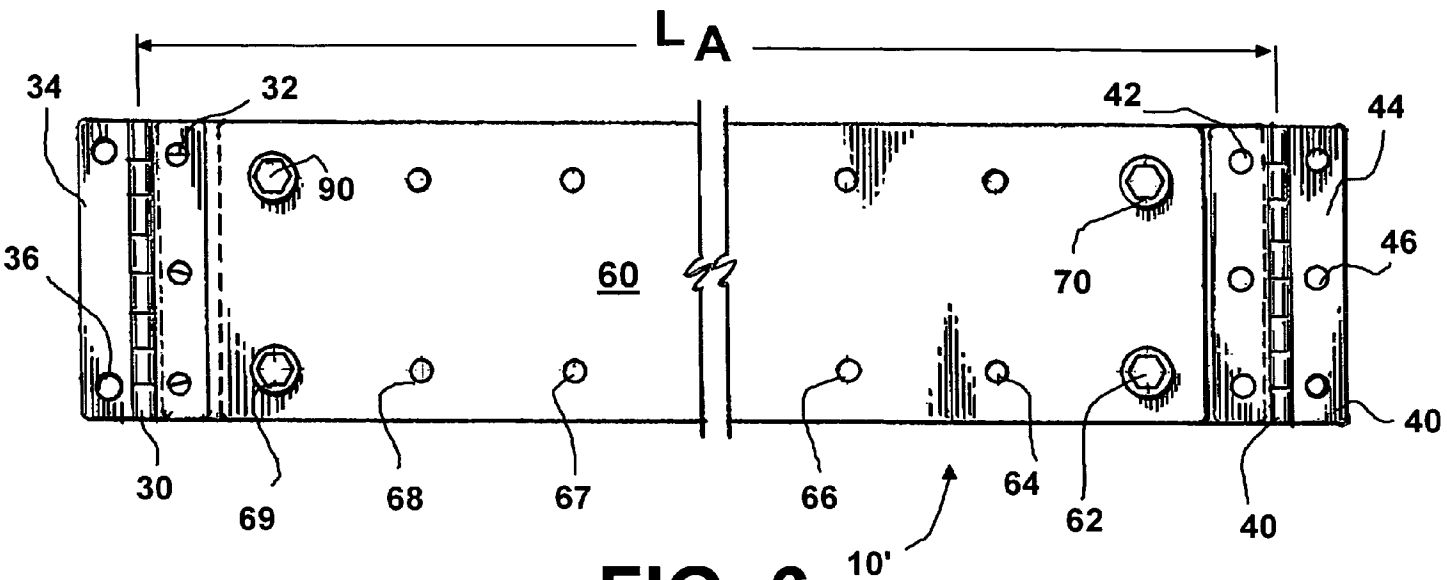
FIG. 6 is a top view of an alternative mounting bracket whose length is adjustable.

FIG. 6 is a top view of an alternative mounting bracket 10' whose length LA is adjustable. FIG. 7 is a side view of mounting bracket 10'. Plate 20' of mounting bracket 10' can comprise first section 60 and second section 80. First section 60 can include sets of adjustment openings 62, 64, 66, 67, 68, and 69. Second section 80 can include sets of adjustment openings 82, 84, 86, 87, 88, and 89. The sets of adjustment openings can be longitudinally spaced along the respective lengths of first section 60 and second section 80. Additionally, in one embodiment the sets of adjustment openings in first section 60 can be equally longitudinally spaced to coincide with the sets of adjustment openings in second section 80. To select an overall length L for mounting bracket 10' first section 60 and second section 80 can be aligned relative to each other and a plurality of fasteners 70 and 90 can be used to fasten the two sections together. For example, in FIG. 6 sixth set of adjustment openings 69 of first section are aligned (and fastened with plurality of fasteners 90) with sixth set of adjustment openings 89 of second section 80. Additionally, first set of adjustment openings 62 of first section 60 are aligned (and fastened with plurality of fasteners 70) with first set of adjustment openings 82 of second section 80. As another example, fifth set of adjustment openings 64 of first section 60 are aligned (and fastened with plurality of fasteners 90) with first set of adjustment openings 89 of second section 80 to provide a long length L. More than four fasteners can be used to connect first and second sections 60, 80. In FIG. 6 up to twelve fasteners could be used (although this is likely not necessary) depending on the number of holes available to accept fasteners.

FIG. 8 shows another embodiment for the method and apparatus. FIG. 8 is a side view of satellite antenna dish 200 mounted with adjustable mounting bracket 10' attached to soffit 120 which soffit 120 is angled relative to a ground surface (although the ground surface is not shown). In FIG. 8 fascia 110 includes top 112 and bottom 114 surfaces. Gutter 130 is attached to fascia 110. Upper portion 260 of mount 250 is connected to fascia 110 between top 112 and bottom 114 surfaces and, more particularly, between the bottom of gutter 130 and bottom 114 of fascia. This connection can be by a plurality of fasteners (such as wood screws, threaded bolts and nuts, nails, rivets, adhesives, etc.). In this mounting situation lower portion 270 of mount 250 extends below bottom 114 of fascia 110. Loads on satellite antenna dish 200 after installation can place torsional or bending loading on mount 250 and accordingly on any item to which mount 250 is connected. To address this torsional or bending loading mounting bracket 10' can be attached to lower portion 270 of mount 250 through second mounting portion 44 of mounting bracket 10. Second mounting portion 44 is hinged at hinged connection 40 and allows plate 20 to form an angle theta 5 relative to mount 250. First mounting portion 34 can be connected to soffit 120, preferably in a rafter 150. First mounting portion 34 can be pivotally connected to plate 20 through hinged connection 30 allowing connection by forming angle theta 6 with soffit 120. Here, the length L of plate 20' has been adjusted (by locating fasteners 70, 90 in their selected sets of adjustment openings on first and second sections 60 and 80) to place first mounting portion 34 at a desired location relative to the transition point between soffit 120 and wall 104. Loading on satellite antenna dish 200 can be resisted by mounting bracket 10 which transfers the loading forces to soffit 120 and rafter 150.

FIG. 9 shows another embodiment for the method and apparatus. FIG. 9 is a side view of satellite antenna dish 200 mounted with adjustable mounting bracket 10' attached to wall 104 where soffit 120 is substantially horizontal relative to a ground surface (although the ground surface is not shown). In FIG. 9 fascia 110 includes top 112 and bottom 114 surfaces. Gutter 130 is attached to fascia 110. Upper portion 260 of mount 250 is connected to fascia 110 between top 112 and bottom 114 surfaces and, more particularly, between the bottom of gutter 130 and bottom 114 of fascia. This connection can be by a plurality of fasteners (such as wood screws, threaded bolts and nuts, nails, rivets, adhesives, etc.). In this mounting situation lower portion 270 of mount 250 extends below bottom 114 of fascia 110. Loads on satellite antenna dish 200 after installation can place torsional or bending loading on mount 250 and accordingly on any item to which mount 250 is connected. To address this torsional or bending loading mounting bracket 10' can be attached to lower portion 270 of mount 250 through second mounting portion 44 of mounting bracket 10. Second mounting portion 44 is hinged at hinged connection 40 and allows plate 20 to form an angle theta 7 relative to mount 250. First mounting portion 34 can be connected to wall 104, preferably in a stud 106. First mounting portion 34 can be pivotally connected to plate 20 through hinged connection 30 allowing connection by forming angle theta 8 with stud 106 or wall 104. Here, the length L of plate 20' has been adjusted (by locating fasteners 70, 90 in their selected sets of adjustment openings on first and second sections 60 and 80) to place first mounting portion 34 at a desired location relative to the wall 104. Although plate 20' is shown as being substantially horizontal, this need not be the case and can be angled upwardly or downwardly as desired depending on the distance D to be traversed and the adjusted length L. If not substantially horizontal, angles theta 7 and 8 are expected to be less and greater than ninety degrees. Loading on satellite antenna dish 200 can be resisted by mounting bracket 10 which transfers the loading forces to wall 104 or stud 106 (not shown).

Although not shown in FIG. 9 mounting bracket 10' can be attached to substantially horizontal soffit 120. The process would be similar to that discussed regarding FIG. 8 with an angled soffit 120 (or in FIG. 4 with non-longitudinally adjustable mounting bracket 10). The longitudinal adjustability of mounting bracket 10' better allows placement of first mounting portion 34 relative to its selected position for attachment to soffit 120.

FIG. 10 is a top view of an alternative mounting bracket 10" whose length LA is adjustable and includes a c-channel cross section. FIG. 11 is a side view of mounting bracket 10". FIG. 12 is a sectional view of mounting bracket 10" taken along the lines 12-12. Plate 20" of mounting bracket 10" can comprise first section 60 and second section 80. First and second sections can respectively include first and second side sets 72,74 and 92,94 which can cause first and second sections 60,80 to be C-channels and increase their resistance to bending along the length L of plate 20". First section 60 can include sets of adjustment openings 62, 64, 66, 67, 68, and 69. Second section 80 can include sets of adjustment openings 82, 84, 86, 87, 88, and 89. The sets of adjustment openings can be longitudinally spaced along the respective lengths of first section 60 and second section 80. Additionally, in one embodiment the sets of adjustment openings in first section 60 can be equally longitudinally spaced to coincide with the sets of adjustment openings in second section 80. To select an overall length L for mounting bracket 10' first section 60 and second section 80 can be aligned relative to each other and a plurality of fasteners 70 and 90 can be used to fasten the two sections together. For example, in FIG. 6 sixth set of adjustment openings 69 of first section are aligned (and fastened with plurality of fasteners 90) with sixth set of adjustment openings 89 of second section 80. Additionally, first set of adjustment openings 62 of first section 60 are aligned (and fastened with plurality of fasteners 70) with first set of adjustment openings 82 of second section 80. As another example, fifth set of adjustment openings 64 of first section 60 are aligned (and fastened with plurality of fasteners 90) with first set of adjustment openings 89 of second section 80 to provide a long length L. More than four fasteners can be used to connect first and second sections 60, 80. In FIG. 6 up to twelve fasteners could be used (although this is likely not necessary) depending on the number of holes available to accept fasteners.

The following is a table of reference numerals and descriptions.

| Reference Number | Description |
|---|---|
| 10 | brace |
| 20 | plate |
| 30 | hinged connection |
| 32 | fasteners |
| 34 | mounting portion |
| 36 | plurality of openings |
| 40 | hinged connection |
| 42 | fasteners |
| 44 | mounting portion |
| 46 | plurality of openings |
| 60 | first section |
| 62 | first set of adjustment openings |
| 64 | second set of adjustment openings |
| 66 | third set of adjustment openings |
| 67 | fourth set of adjustment openings |

-continued

| Reference Number | Description |
|---|---|
| 68 | fifth set of adjustment openings |
| 69 | sixth set of adjustment openings |
| 70 | fasteners for first section |
| 72 | first side of first section |
| 74 | second side of first section |
| 80 | second section |
| 82 | first set of adjustment openings |
| 84 | second set of adjustment openings |
| 86 | third set of adjustment openings |
| 87 | fourth set of adjustment openings |
| 88 | fifth set of adjustment openings |
| 89 | sixth set of adjustment openings |
| 90 | fasteners for second section |
| 92 | first side of second section |
| 94 | second side of second section |
| 100 | home |
| 112 | upper end of fascia |
| 114 | lower end of fascia |
| 104 | wall |
| 106 | stud |
| 110 | fascia |
| 120 | soffit |
| 130 | gutter |
| 140 | roof |
| 150 | rafter |
| 160 | joist |
| 200 | satellite |
| 250 | mount for satellite antenna dish |
| 260 | upper portion of mount |
| 270 | lower portion of mount |
| 280 | adjustment track |
| 290 | pivot point |
| 300 | plurality of fasteners |
| 302 | nuts |
| D | depth of fascia to side wall |
| M | moment arm |
| T | torsional load |
| F | loading force |

All measurements disclosed herein are at standard temperature and pressure, at sea level on Earth, unless indicated otherwise.

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

What is claimed is:

1. A method of mounting a satellite antenna to a building having a fascia comprising the steps of:

(a) providing a satellite antenna dish, the dish having a mount having upper and lower portions;

(b) providing a mounting bracket having a body along with first and second mounting ends, the first and second mounting ends being pivotally connected to the body;

(c) attaching the upper portion of the mount to the fascia;

(d) attaching the lower portion of the mount to the second mounting end; and (e) attaching the first mounting end to a portion of the building.

2. The method of claim 1, wherein the building has a soffit and the first mounting end is attached to the soffit.

3. The method of claim 2, wherein the soffit is substantially horizontal.

4. The method of claim 2, wherein the soffit is substantially skewed.

5. The method of claim 2, wherein the soffit includes at least one rafter, and the first mounting end is attached to the rafter.

6. The method of claim 2, wherein the soffit includes at least one joist, and the first mounting end is attached to the joist.

7. The method of claim 1, wherein the building has a wall and the first mounting end is attached to the wall.

8. The method of claim 7, wherein the wall has at least one stud, and the first mounting end is attached to the stud.

9. The method of claim 7, wherein the body is installed at a substantially horizontal position.

10. The method of claim 7, wherein the body is installed at an angled upwardly pitch.

11. The method of claim 7, wherein the body is installed at an angled downwardly pitch.

12. The method of claim 1, wherein the fascia has a gutter and the upper portion of the mount is installed below the gutter, and the satellite antenna dish and mount cradle the gutter.

13. The method of claim 1, wherein the body portion has an adjustable length and this length is adjusted before step "e."

14. The method of claim 13, wherein the body portion has first and second sections, and first section has a plurality of paired and longitudinally spaced openings, and second section has a plurality of paired and longitudinally spaced openings, and at least two of these paired sets of openings are connected together for adjusting the length of the body.

15. The method of claim 13, wherein the body forms a c-channel.

16. The method of claim 1, wherein the body has a rectangular cross section.

* * * * *